US008276299B2

(12) United States Patent
Schütz

(10) Patent No.: US 8,276,299 B2
(45) Date of Patent: Oct. 2, 2012

(54) LABELING PLATE FOR SHIPPING AND STORAGE TANKS FOR LIQUIDS AND BULK MATERIALS

(75) Inventor: Udo Schütz, Selters/Westerwald (DE)

(73) Assignee: Protechna S.A., Fribourg (CH)

( * ) Notice: Subject to any disclaimer, the term of this patent is extended or adjusted under 35 U.S.C. 154(b) by 372 days.

(21) Appl. No.: 12/460,895

(22) Filed: Jul. 24, 2009

(65) Prior Publication Data

US 2010/0055380 A1 Mar. 4, 2010

(30) Foreign Application Priority Data

Sep. 4, 2008 (DE) ..... 10 2008 045 758

(51) Int. Cl.
*G09F 3/20* (2006.01)

(52) U.S. Cl. ..... 40/661.08; 40/308; 428/81; 428/99

(58) Field of Classification Search ..... 428/81, 428/99, 136; 40/661.08, 308; 220/9.1
See application file for complete search history.

(56) References Cited

U.S. PATENT DOCUMENTS 5,235,767 A * 8/1993 Waterman et al. ..... 40/308
2006/0288620 A1* 12/2006 Weyrauch et al. ..... 40/611.01

FOREIGN PATENT DOCUMENTS

DE 195 37 490 2/1997

* cited by examiner

*Primary Examiner* — Alexander Thomas
(74) *Attorney, Agent, or Firm* — Lucas & Mercanti, LLP; Klaus P. Stoffel

(57) ABSTRACT

A labeling plate, which is to be fastened to the outside surface of the outer cage of a shipping and storage tank for liquids, has an upper and lower frame section and two lateral frame sections, which project outwardly beyond the labeling area of the labeling plate and frame the labeling surface. The labeling areas of the labeling plates of two storage tanks standing side by side on a loading surface are kept spaced apart by the frame sections, so that damage to the labels pasted on the labeling areas of the labeling plates is avoided.

9 Claims, 5 Drawing Sheets

Fig. 3
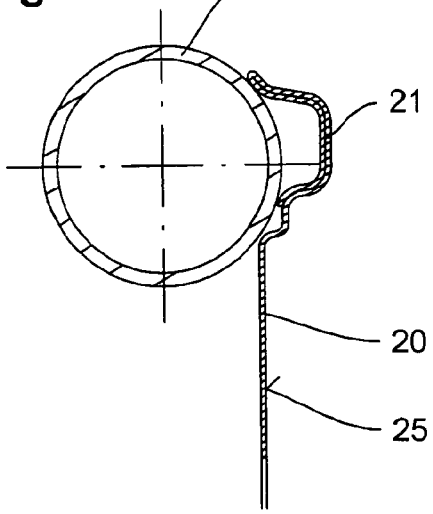
Fig. 5
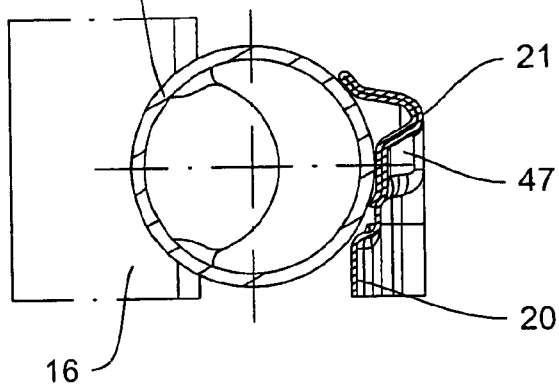
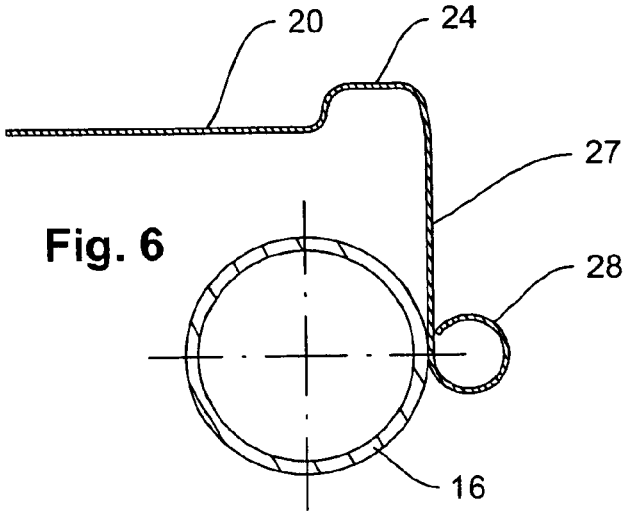
Fig. 6
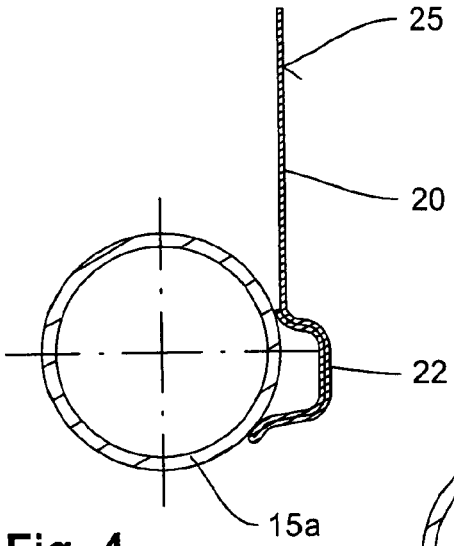
Fig. 4
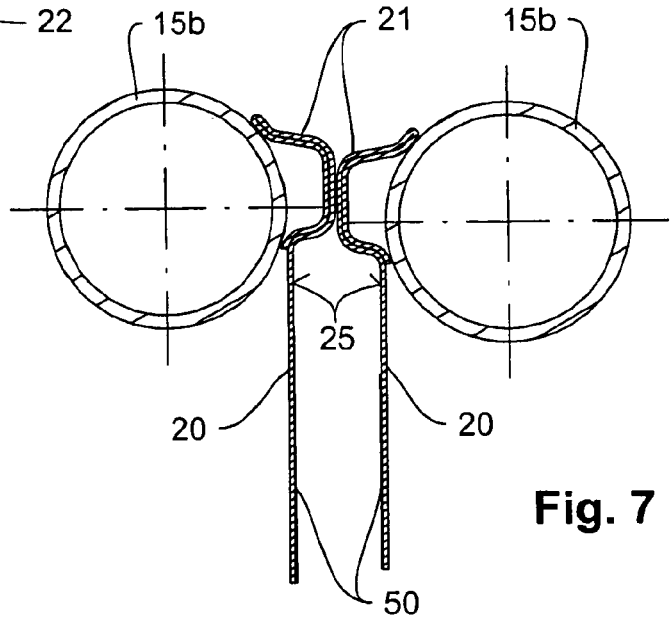
Fig. 7

LABELING PLATE FOR SHIPPING AND STORAGE TANKS FOR LIQUIDS AND BULK MATERIALS

BACKGROUND OF THE INVENTION

1. Field of the Invention

The present invention relates to a labeling plate for shipping and storage tanks for liquids and bulk materials, which are equipped with a plastic inner tank with a closable filling hole and a drain hole with a tapping valve, a pallet-like support frame for supporting the inner tank, and an outer cage, which is mounted on the support frame and consists of horizontal and vertical metal cage bars for supporting the filled inner tank, wherein the cage bars are welded together at the points of intersection, and the sheet-metal labeling plate, which has limited flexural elasticity, is mounted on the outer cage.

2. Description of the Related Art

Tanks of this type for shipping and storing liquids and bulk materials, which are also known as pallet tanks, are widely known in various embodiments. In these pallet tanks, a labeling plate is usually mounted on the outer cage, on the front side, where the tapping valve is located. An information sheet or several data sheets indicating the contents of the tank, the producer of the contents, the manufacturer of the pallet tank, the registration number and similar data are pasted on this labeling plate or are inserted in a clear plastic pocket attached to the labeling plate.

DE 195 37 490 C1 describes a labeling plate of the general type specified above for pallet tanks with an outer cage, which consists of horizontal and vertical metal cage bars in the form of round tubes, which are recessed at the points of intersection to form trough-shaped, double-walled depressions that run in the longitudinal direction of the cage bars in such a way that the cage bars, which are welded together at their points of intersection lie practically in a plane. The labeling plate is attached to the outer cage and has a lower support edge, which is outwardly beveled or flanged, abuts a lower horizontal cage bar and grips behind it, while the upper edge, which is designed as a clawed edge, fits behind an upper horizontal cage bar in the mounted state of the labeling plate to elastically brace the labeling plate. In another embodiment of this previously known labeling plate, the outer edges of the upper corner areas of the labeling plate have special insert sleeves for plastic clamping pins. Each clamping pin has a head, which, in the mounted state of the labeling plate, fits into the trough-shaped depressions of the upper horizontal cage bar and in this way fixes the labeling plate in place. A plastic push button with web and film-hinge bolts that are like spreading wedges is used as a tamper-proof seal. The push button is pressed into a corresponding depression on the upper edge of the sheet-metal labeling plate.

The known pallet tanks, which are used for storing and shipping all types of liquid products of the chemical, pharmaceutical, petroleum and food industries, have the disadvantage that, during shipment in trucks, as a result of relative movement of two adjacent pallet tanks due to movement of the loading surface of the truck when the truck drives over bumps or rough areas of a roadway surface or due to driving vibrations of the transport vehicle, the label pasted onto the labeling plate of one of the pallet tanks is rubbed off by the cage bars of the outer cage of the adjacent pallet tank and rendered illegible.

SUMMARY OF THE INVENTION

The object of the invention is to further develop the labeling plate for shipping and storage tanks for liquids of the general type described above with respect to optimum protection of the label pasted on the labeling surface of the plate against the external application of force, especially during shipment, and, in addition, to simplify the mounting of the labeling plate.

In accordance with the invention, this object is met by a labeling plate for shipping and storage tanks for liquids and bulk materials, which are equipped with a plastic inner tank with a closable filling hole and a drain hole with a tapping valve, a pallet-like support frame for supporting the inner tank, and an outer cage, which is mounted on the support frame and consists of horizontal and vertical metal cage bars for supporting the filled inner tank, wherein the cage bars are welded together at the points of intersection, and the sheet-metal labeling plate, which has limited flexural elasticity, is mounted on the outer cage. Provided are an upper and a lower frame section and two lateral frame sections, which project outwardly beyond the labeling area of the labeling plate and frame the labeling surface, and characterized by two beveled or flanged lateral edges with an upper and a lower, outwardly directed edge section, with an upper, upwardly directed opening, with a middle, inwardly directed opening, and with a lower, downwardly directed opening, where the upper edge section of the two lateral edges projects upward beyond the upper opening in the lateral edges, and the lower edge section of the two lateral edges projects downward beyond the opening in the lateral edges, in such a way that in the mounted state of the labeling plate, the upper and lower frame sections of the labeling plate rest against an upper and a lower horizontal cage bar of the outer cage; the labeling plate rests with the upper, the middle and the lower openings of the two lateral edges elastically braced against the upper, the middle and the lower horizontal cage bar; the upper and the lower edge sections of the two lateral edges of the labeling plate grip behind the upper and the lower horizontal cage bars; and the two lateral edges of the labeling plate rest with the upper and the lower edge sections against a vertical cage bar of the outer cage.

The labeling plate of the invention embodies a simple and effective solution of the problem to be solved.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the Drawing

FIGS. 3 to 6 are enlarged cross-sectional views along lines III-III to VI-VI in FIG. 2.

FIG. 7 is an enlarged partial cross-sectional view of two labeling plates abutting along their upper frame sections.

DETAILED DESCRIPTION OF THE INVENTION

Figure 1:
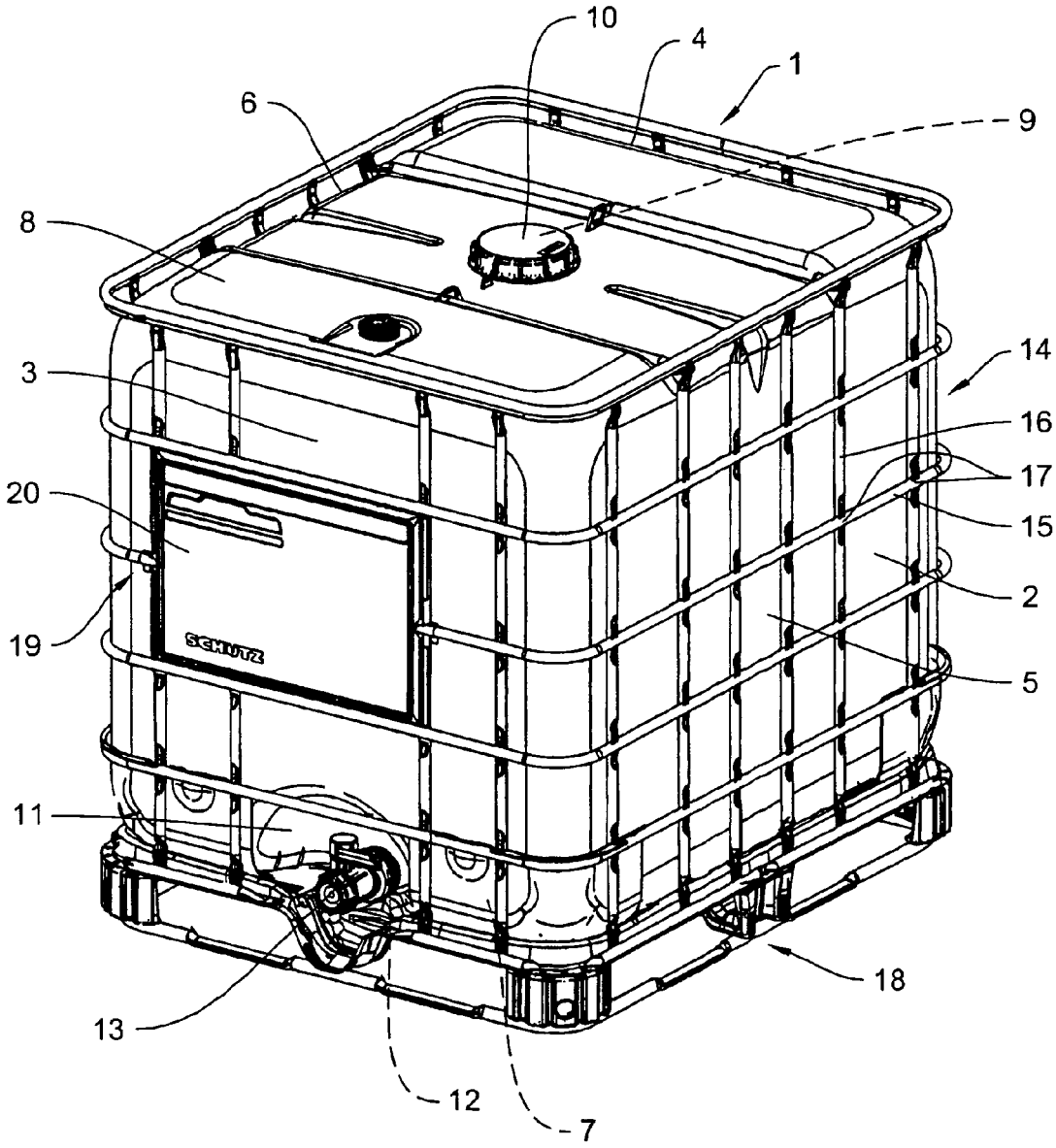
FIG. 1 is a perspective view of a shipping and storage tank for liquids with a labeling plate.

The shipping and storage tank 1 for liquids that is shown in FIG. 1, which can be used as a disposable or reusable tank, is a pallet tank and has as its principal components (1) a replaceable rectangular-solid plastic inner tank 2 with a front wall 3, a rear wall 4 and two sidewalls 5, 6, with a base 7 designed as a drain base and an upper base 8, with a filling socket 9 that is formed on the upper base 8 and can be closed with a cap 10, and with a drain socket 12, which is formed on a dome-shaped recess 11 in the lower section of the front wall 3 of the inner tank 2, is produced as a single part with the inner tank 2 by blow molding, and serves to mount a tapping valve 13; (2) an outer jacket 14 in the form of a cage, which consists of intersecting horizontal and vertical, tubular, metal cage bars 15, 16 that are welded together at the points of intersection 17 and which serves the purpose of holding the inner tank 2; and (3) a pallet-like support frame 18 with standard European dimensions of length and width for supporting the inner tank 2.

Figure 2:
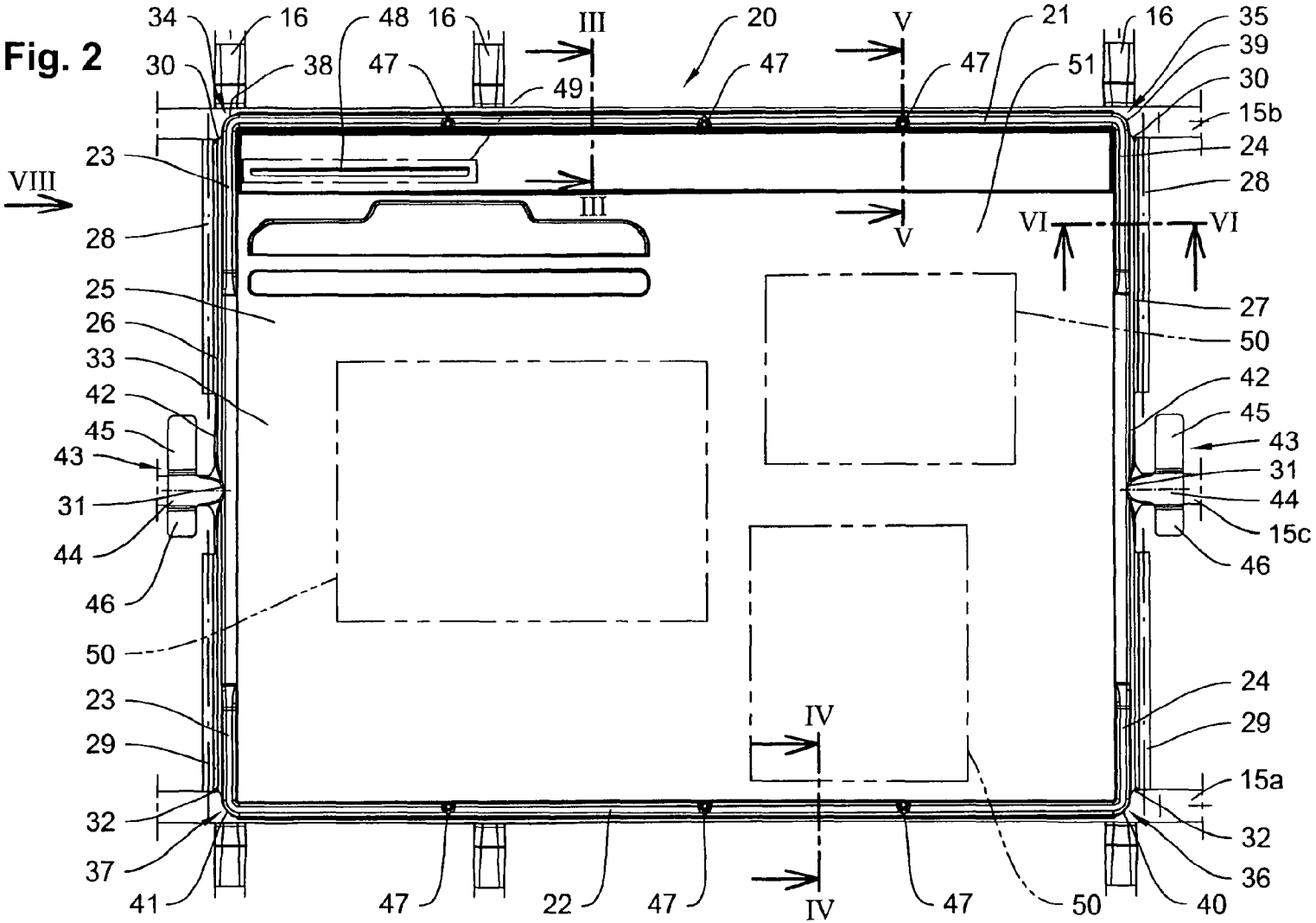
FIG. 2 is an enlarged front view of the labeling plate.
Figure 8:
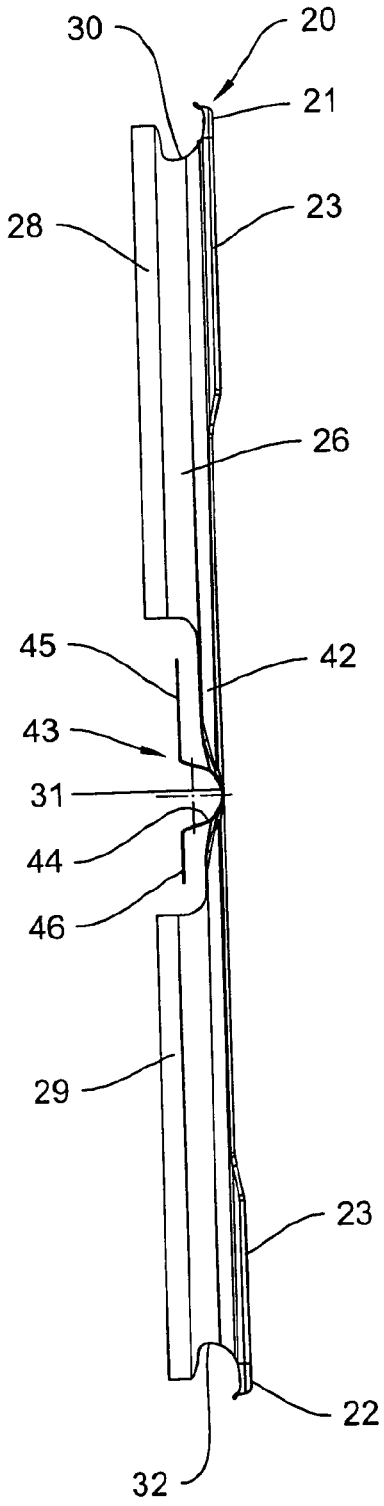
FIG. 8 is an enlarged side view of the labeling plate in the direction of arrow VIII in FIG. 2.

The sheet-metal labeling plate 20 according to FIG. 2, which is to be mounted on the outer surface 19 of the outer cage 14 of the shipping tank 1, has an upper and a lower frame section 21, 22 and two lateral frame sections 23, 24, which project outwardly beyond the labeling area 25 of the labeling plate 20 and frame the labeling surface. The labeling plate 20 also has two inwardly beveled or flanged lateral edges 26, 27 with an upper and a lower, outwardly directed edge section 28, 29 designed as a roll, with an upper, upwardly directed opening 30, with a middle, inwardly directed opening 31, and with a lower, downwardly directed opening 32, where the upper edge section 28 of the two lateral edges 26, 27 projects upward beyond the upper opening 30 in the lateral edges, and the lower edge section 29 of the two lateral edges 26, 27 projects downward beyond the opening 32 in the lateral edges.

In the mounted state of the labeling plate 20, the upper and lower frame sections 21, 22 of the labeling plate 20 rest against an upper and a lower horizontal cage bar 15*b*, 15*a* of the outer cage 14; the labeling plate 20 rests with the upper, the middle and the lower openings 30, 31, 32 of the two lateral edges 26, 27 elastically braced against an upper, a middle and a lower horizontal cage bar 15*b*, 15*c*, 15*a*; the upper and the lower edge sections 28, 29 of the two lateral edges 26, 27 of the labeling plate 20 grip behind the upper and the lower horizontal cage bars 15*b*, 15*a*; and the two lateral edges 26, 27 of the labeling plate 20 rest with the upper and the lower edge sections 28, 29 against a vertical cage bar 16 of the outer cage 14.

The upper and the lower frame sections 21, 22 of the labeling plate 20 are reinforced by doubling the sheet-metal material.

The two lateral frame sections 23, 24 of the labeling plate 20 are interrupted in the middle section 33 of the labeling plate 20.

The four corners 34-37 of the rectangular labeling plate 20 are furnished with edge protection, which is formed by rounded transitions 38-41 between the upper and lower frame sections 21, 22 and the lateral frame sections 23, 24.

A clamp 43 for fastening the labeling plate 20 to the middle horizontal cage bar 15*c* is formed on each middle section 42 of the two lateral edges 26, 27. The clamps 43 have a split fastening sleeve 44 on the periphery of the middle opening 31 of the two lateral edges 26, 27 of the labeling plate 20, which fastening sleeve 44 is formed on the lateral edges, for placement on the horizontal middle cage bar 15*c*, and two clamping tongues 45, 46 with different lengths formed opposite each other on the fastening sleeve 44. To mount the labeling plate 20 on the horizontal middle cage bar 15*c*, the long clamping tongue 45 of the two clamps 43 are bent around the cage bar 15*c* towards the short clamping tongue 46 and clinched with it.

The upper and lower frame sections 21, 22 of the labeling plate 20 have impressions 47 spaced some distance apart for the purpose of reinforcement.

The labeling plate 20 is provided with a punched-out slot 48, which acts as an antenna amplifier when covered by a transponder 49 that has been pasted onto the labeling area 25 and that contains data stored for identification of the contents of the tank.

FIG. 2 shows the labeling plate 20 with lettered labels 50 of different formats pasted onto its labeling area 25.

FIG. 7 illustrates how the labeling plates 20 of two shipping tanks located side by side on a loading surface are kept spaced apart by the frame sections 21-24 of the labeling plates. This prevents contact between the labeling areas 25 of the labeling plates and thus damage to the labels 50 pasted on the labeling areas 25 of the labeling plates.

Figure 9A:
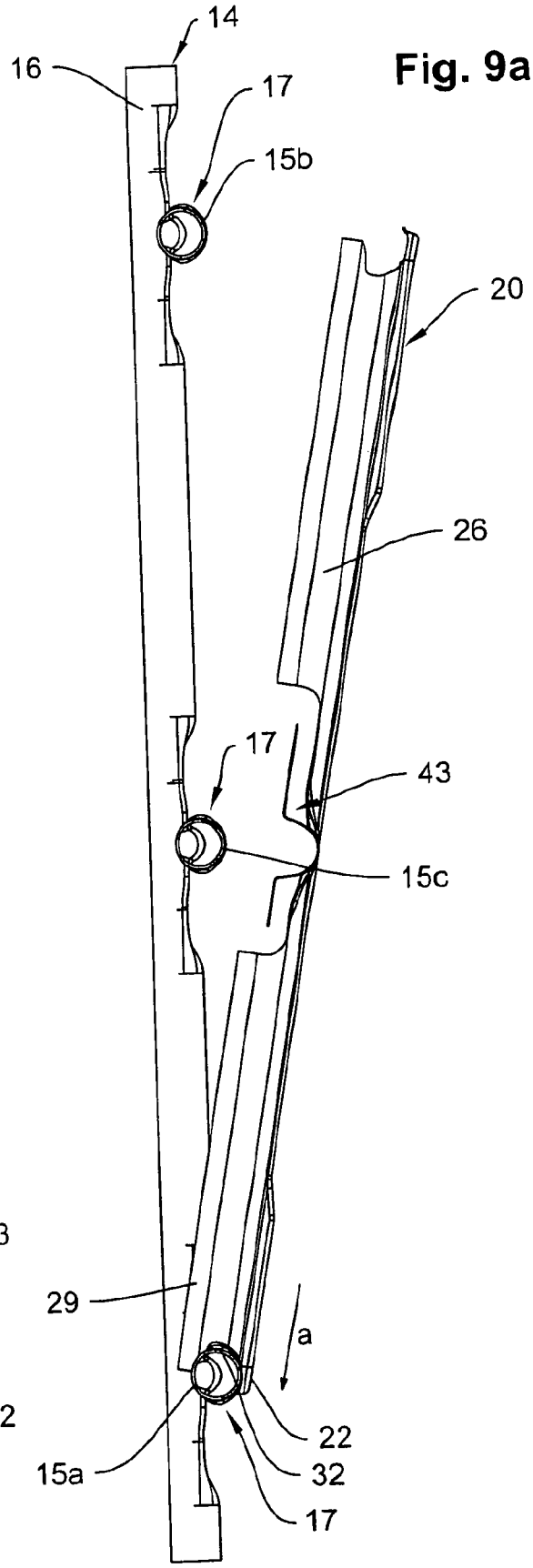
FIGS. 9*a* to 9*d* show the mounting of the labeling plate according to FIGS. 2 to 8 on the outer cage of a pallet tank in four successive steps.
Figure 9B:
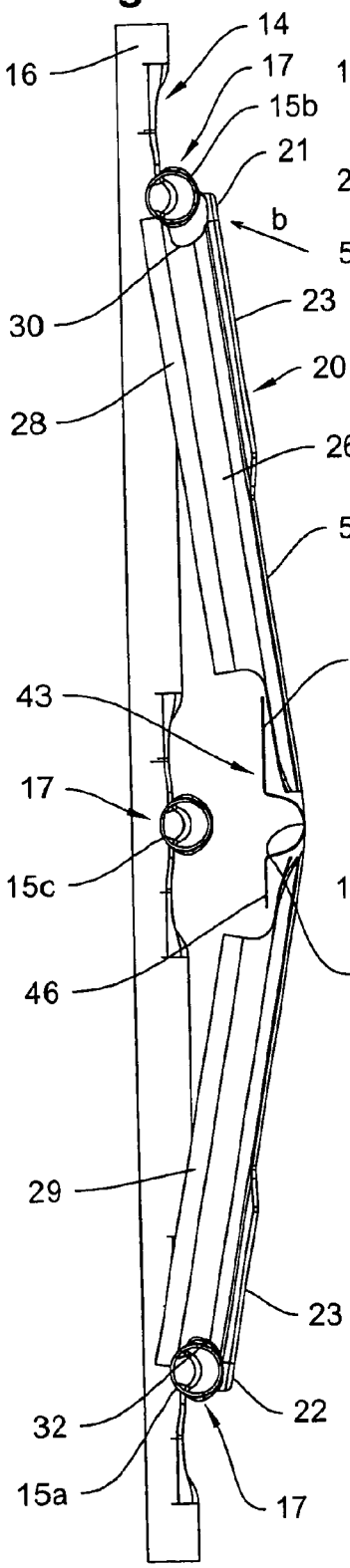
Figure 9C:
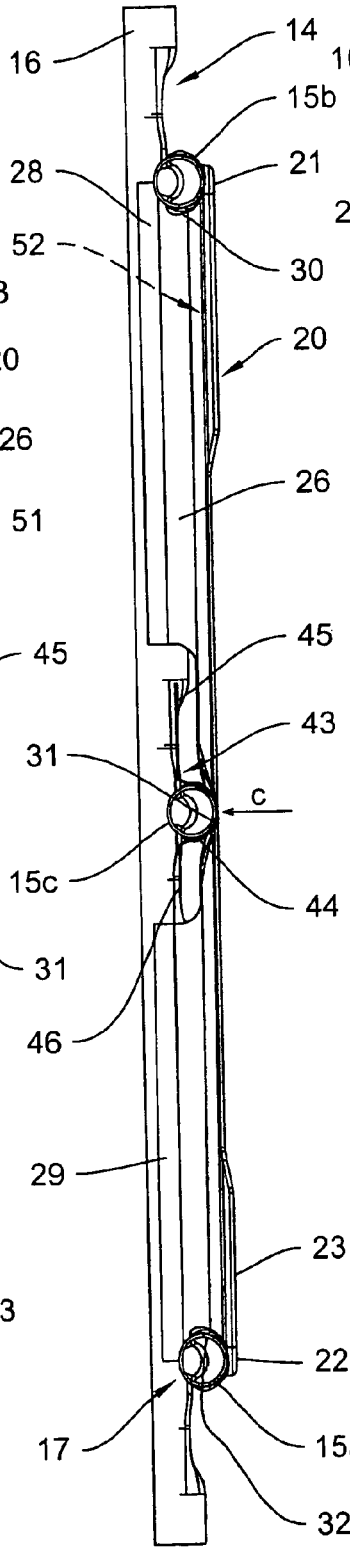
Figure 9D:
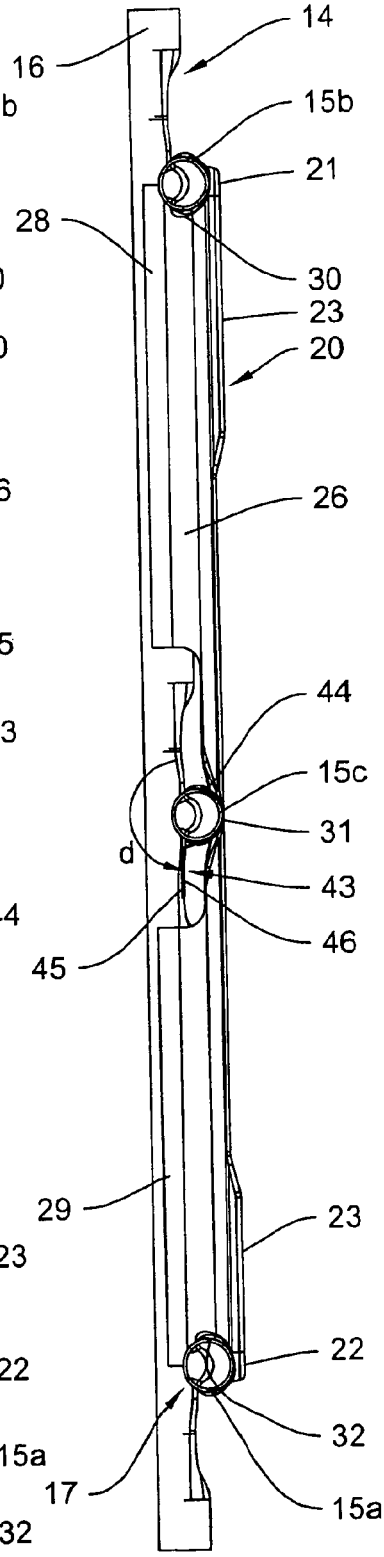

FIGS. 9*a* to 9*d* illustrate the mounting of the labeling plate 20 on the outer cage 14 of the shipping and storage tank 1. As shown in FIG. 9*a*, the labeling plate 20, in a slightly oblique position, is first placed with the lower openings 32 in the two lateral edges 26, 27 onto the lower horizontal cage bar 15*a* in arrow direction a. In this regard, the lower trapezoidal frame section 22 rests from the outside on the cage bar 15*a*, and the lower rolled edge sections 29 of the two lateral edges 26, 27 of the labeling plate 20 grip the lower horizontal cage bar 15*a* from behind and come to rest on two vertical cage bars 16 that are spaced according to the cage bar spacing of the outer cage 14. As shown in FIG. 9*b*, the upper half 51 of the labeling plate 20 is then bent so far inward in arrow direction b that the upper frame section 21 of the labeling plate comes to rest on the upper horizontal cage bar 15*b*, and the upper openings 30 of the two lateral edges 26, 27 of the labeling plate 20 occupy a position below the upper horizontal cage bar 15*b*. As shown in FIG. 9*c*, the rear side 52 of the labeling plate 20 is then pushed against the middle horizontal cage bar 15*c* in arrow direction c. This causes the upper openings 30 of the two lateral edges 26, 27 of the labeling plate 20 to snap onto the upper horizontal cage bar 15*b* to produce elastic bracing of the labeling plate 20, such that the upper frame section 21 slides farther onto the upper horizontal cage bar 15*b*, and the middle openings 31 of the two lateral edges 26, 27 and the split fastening sleeves 44 of the two clamps 43 of the labeling plate 20 engage the middle horizontal cage bar 15*c*. Finally, as shown in FIG. 9*d*, the long clamping tongues 45 of the two clamps 43 of the labeling plate 20 are bent in arrow direction d around the middle horizontal cage bar 15*c* towards the short clamping tongues 46, and the clamping tongues 45, 46 of the two clamps 43 are clinched together, so that reliable fastening of the labeling plate 20 on the outer cage 14 of the shipping and storage tank 1 is ensured.

While specific embodiments of the invention have been shown and described in detail to illustrate the inventive principles, it will be understood that the invention may be embodied otherwise without departing from such principles.

I claim:

1. An assembly comprising:

shipping and storage tanks for liquids and bulk materials, which are equipped with a plastic inner tank with a closable filling hole and a drain hole with a tapping valve, a support frame for supporting the inner tank, and an outer cage, which is mounted on the support frame and is comprised of horizontal and vertical metal cage bars for supporting the filled inner tank, where the cage bars are welded together at the points of intersection; and a sheet metal labeling plate, having limited flexural elasticity and being mounted on the outer cage, the labeling plate comprising an upper and a lower frame section and two lateral frame sections, which project outwardly beyond a labeling area of the labeling plate and frame a labeling surface, and two beveled or flanged lateral edges with an upper and a lower, outwardly directed edge section, with an upper, upwardly directed opening, with a middle, inwardly directed opening, and with a lower, downwardly directed opening, wherein the upper edge section of the two lateral edges projects upward beyond the upper opening in the lateral edges, and the lower edge section of the two lateral edges projects downward beyond the opening in the lateral edges, such that after elastic deformation of the labeling plate for assembly of the labeling plate, in a mounted state of the labeling plate, the upper and lower frame sections of the labeling plate rest against an upper and a lower horizontal cage bar of the outer cage, the labeling plate resting with the upper, the middle and the lower openings of the two lateral edges elastically braced against the upper, the middle and the lower horizontal cage bar, the upper and the lower edge sections of the two lateral edges of the labeling plate being configured to grip behind the upper and the lower horizontal cage bars, and the two lateral edges of the labeling plate resting against a vertical cage bar of the outer cage with the upper and the lower edge sections.

2. The assembly in accordance with claim 1, wherein the upper and the lower frame sections are produced with a doubling of the sheet-metal material.

3. The assembly in accordance with claim 1, wherein the two lateral frame sections are interrupted in the middle section of the labeling plate.

4. The assembly in accordance with claim 1, wherein the upper and lower edge sections of the lateral edges of the labeling plate are rolls.

5. The assembly in accordance with claim 1, comprising edge protection of the four corners of the rectangular or square labeling plate by means of rounded transitions between the upper and lower frame sections and the lateral frame sections.

6. The assembly in accordance with claim 1, comprising a clamp arranged on each middle section of the two lateral edges for fastening the labeling plate on the horizontal middle cage bar, where the clamps have a split fastening sleeve on the periphery of the middle opening of the two lateral edges of the labeling plate, which fastening sleeve is formed or welded on the lateral edges, for placement on the horizontal middle cage bar, and two clamping tongues with different lengths formed opposite each other on the fastening sleeve, and wherein, to mount the labeling plate on the horizontal middle cage bar, the long clamping tongue is bendable around the cage bar towards the short clamping tongue and joined therewith.

7. The assembly in accordance with claim 6, wherein the long clamping tongue and the short clamping tongue are joined by clinching.

8. The assembly in accordance with claim 1, wherein the upper and lower frame sections have impressions spaced apart for the purpose of reinforcement.

9. The assembly in accordance with claim 1, comprising at least one slot punched out of the labeling plate, which slot acts as an antenna amplifier when covered by a transponder that has been pasted onto the labeling area of the labeling plate and that contains data stored for identification of the contents of the tank.

* * * * *